US008928442B2

(12) United States Patent
Salomäki

(10) Patent No.: US 8,928,442 B2
(45) Date of Patent: Jan. 6, 2015

(54) INDUCTIVE COMPONENT EQUIPPED WITH A LIQUID COOLING AND A METHOD FOR MANUFACTURING AN INDUCTIVE COMPONENT

(75) Inventor: Jarkko Salomäki, Tuusula (FI)

(73) Assignee: Earl Energy, LLC, Virginia Beach, VA (US)

( * ) Notice: Subject to any disclaimer, the term of this patent is extended or adjusted under 35 U.S.C. 154(b) by 0 days.

(21) Appl. No.: 13/380,986

(22) PCT Filed: Jul. 2, 2010

(86) PCT No.: PCT/FI2010/050576

§ 371 (c)(1),
(2), (4) Date: Feb. 21, 2012

(87) PCT Pub. No.: WO2011/004067

PCT Pub. Date: Jan. 13, 2011

(65) Prior Publication Data

US 2012/0133467 A1 May 31, 2012

(30) Foreign Application Priority Data

Jul. 7, 2009 (FI) ..... 20095772

(51) Int. Cl.

| | |
|---|---|
| ***H01F 27/10*** | (2006.01) |
| ***H01F 27/24*** | (2006.01) |
| ***H01F 7/06*** | (2006.01) |
| *H01F 27/26* | (2006.01) |

(52) U.S. Cl.

CPC ..... *H01F 27/10* (2013.01); *H01F 27/263* (2013.01)

USPC ..... 336/57; 336/58; 336/212; 336/233; 29/602.1

(58) Field of Classification Search

USPC ..... 336/55, 57–51, 83, 221, 233, 212; 219/632, 624; 29/602.1

See application file for complete search history.

(56) References Cited

U.S. PATENT DOCUMENTS

| | | | | |
|---|---|---|---|---|
| 2,547,065 | A * | 4/1951 | Wadhams | 336/61 |
| 3,144,627 | A * | 8/1964 | Dunnabeck et al. | 336/55 |
| 3,183,461 | A | 5/1965 | Tipton | |
| 5,438,182 | A * | 8/1995 | Choi | 219/702 |
| 5,973,583 | A * | 10/1999 | Watanabe et al. | 336/131 |
| RE36,787 | E * | 7/2000 | Hansen et al. | 219/632 |
| 2007/0295715 | A1 * | 12/2007 | Saka et al. | 219/624 |

FOREIGN PATENT DOCUMENTS

| | | |
|---|---|---|
| GB | 493739 | 10/1938 |
| WO | WO 2008/104636 A1 | 9/2008 |

* cited by examiner

*Primary Examiner* — Mangtin Lian
(74) *Attorney, Agent, or Firm* — Myers Bigel Sibley & Sajovec, P.A.

(57) ABSTRACT

The object of the invention is an inductive component equipped with a liquid cooling and a method for manufacturing an inductive component. The inductive component comprises at least a core (2) assembled from separate structural elements (8, 8*a*, 8*b*), a winding (5), and connection means (7) as well as ducts (9) integrated into the core (2) for the purpose of liquid cooling. Each structural element (8, 8*a*, 8*b*) comprises an aperture (9*a*, 13, 18) made in the manufacturing phase of the structural element (8, 8*a*, 8*b*), which aperture extends through the structural element and is a short part of the duct (9) intended for the purpose of liquid cooling.

20 Claims, 6 Drawing Sheets

Figure 1:
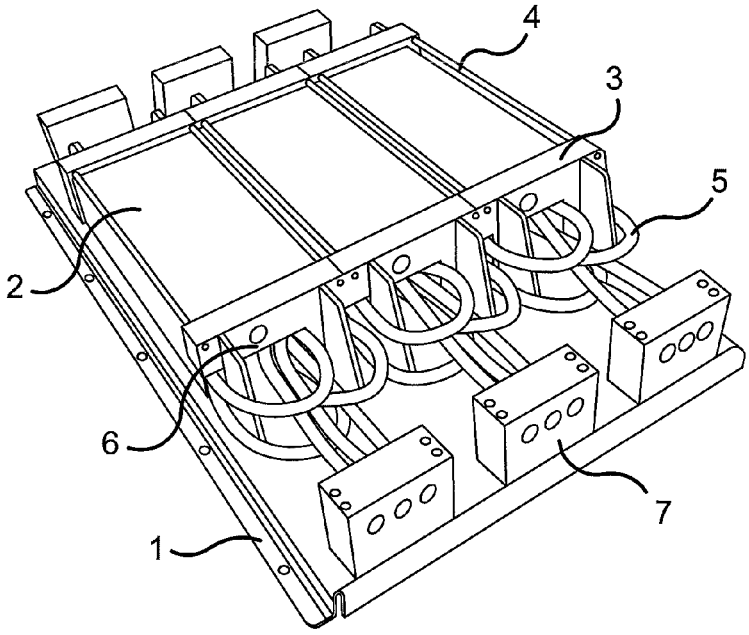

INDUCTIVE COMPONENT EQUIPPED WITH A LIQUID COOLING AND A METHOD FOR MANUFACTURING AN INDUCTIVE COMPONENT

The present invention relates to an inductive component provided with a liquid cooling as defined in the preamble of claim 1 and a method as defined in the preamble of claim 8 for manufacturing the aforementioned inductive component.

Liquid cooling has brought numerous advantages to power electronics, such as reduced temperatures and a smaller size. However, the implementation of liquid cooling has mainly focused on the cooling of power semiconductors, and not very effective solutions have been developed for the liquid cooling of inductive components. In the most common inductive components, only various heat exchangers are disposed on the surface. A drawback in this methodology, however, is that not very effective cooling is achieved, but instead the structure is large in size and does not cool evenly. In this case hot spots remain in the structure and a large part of the losses is transferred to the surrounding air, which detrimentally heats the component cubicle, among other things, and the losses are thus not effectively transferred into the cooling liquid.

The aim of this invention is to eliminate the aforementioned drawbacks and to achieve a simple, inexpensive and efficient liquid cooling structure of inductive components and also a method for manufacturing a liquid cooling structure for inductive components. The cooling idea according to the invention can be used for cooling all types of inductive components, but it is particularly well suited to the cooling of a damped dUdT filter, because in this type of filter the core losses are often dominant. The inductive component according to the invention is characterized by what is disclosed in the characterization part of claim 1. Likewise the method according to the invention is characterized by what is disclosed in the characterization part of claim 8. Other embodiments of the invention are characterized by what is disclosed in the other claims.

Other inventive embodiments may also be discussed in the descriptive section of the present application. The inventive content of the application can also be defined differently than in the claims presented below. In addition it can be stated that at least some of the features of the subordinate claims can at least in some suitable situations be deemed to be inventive in their own right.

One advantage, among others, of the solution according to the invention is that the loss produced in the core of the inductive component can be efficiently transferred into the cooling liquid. Another advantage is that the losses of the winding can be transferred into the cooling liquid via the cores such that the losses are conducted from the winding directly to the cores through the insulation. A further advantage is that the solution according to the invention improves the efficiency of the liquid cooling of inductive components. The solution according to the invention is particularly well suited to improving the efficiency of the cooling of dUdT filters, because in this type of filter the core losses are often dominant.

Figure 2:
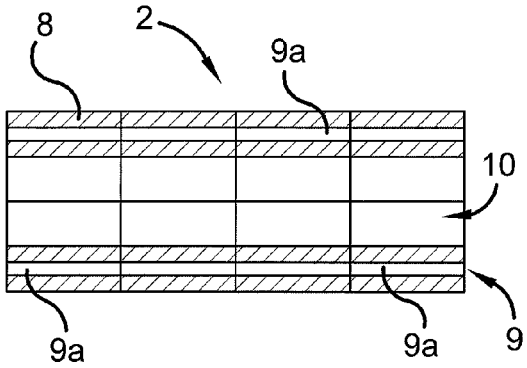
Figure 3:
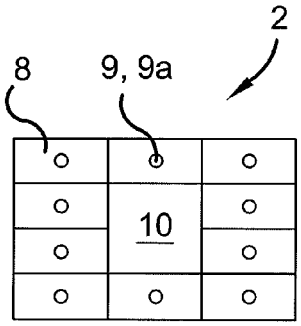
Figure 4:
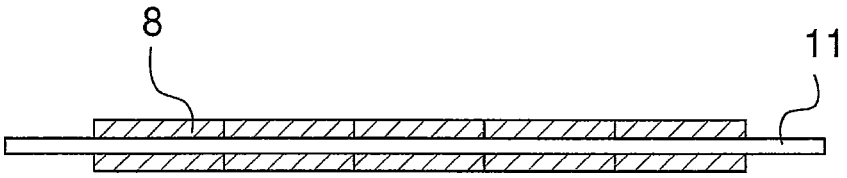
Figure 5:
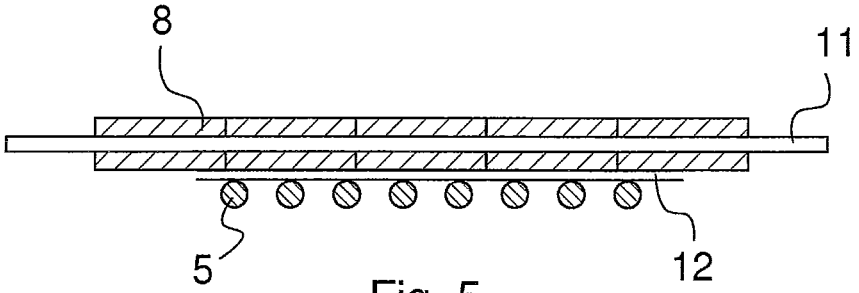
Figure 6:
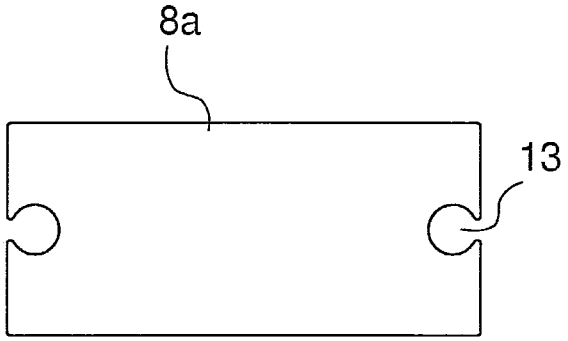
Figure 7:
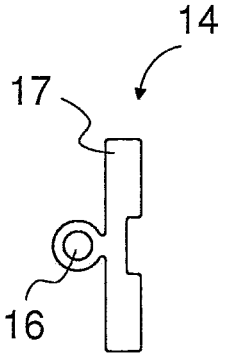
Figure 8:
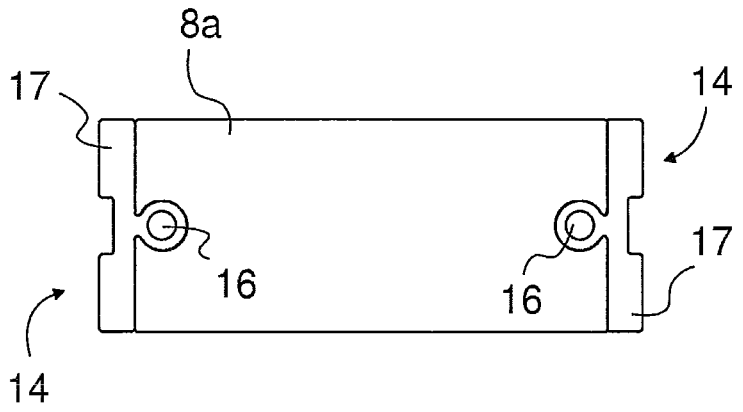
Figure 9:
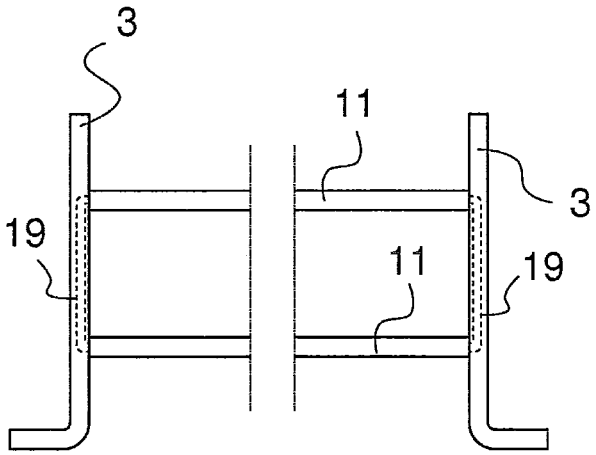
Figure 10:
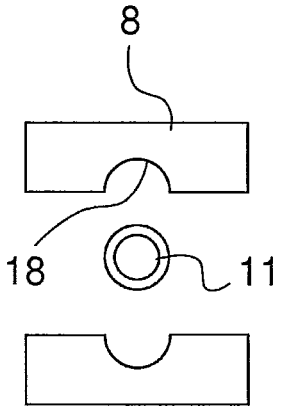
Figure 11:
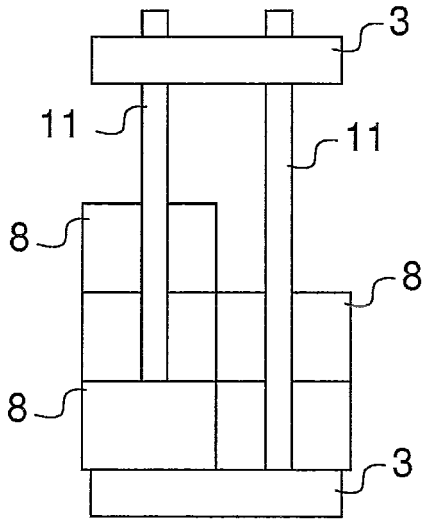
Figure 12:
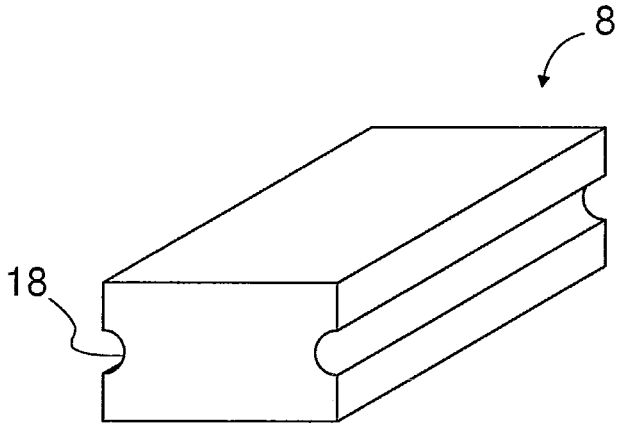
Figure 13:
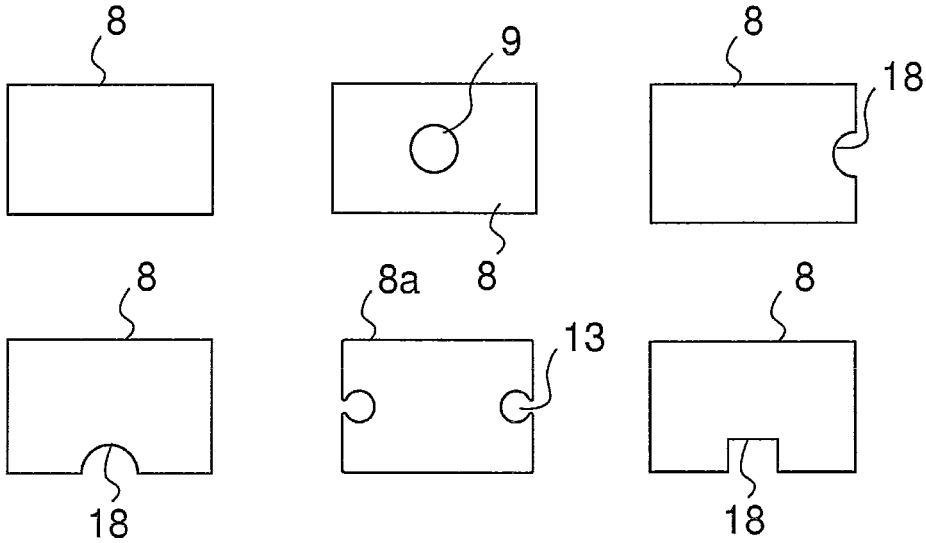
Figure 14:
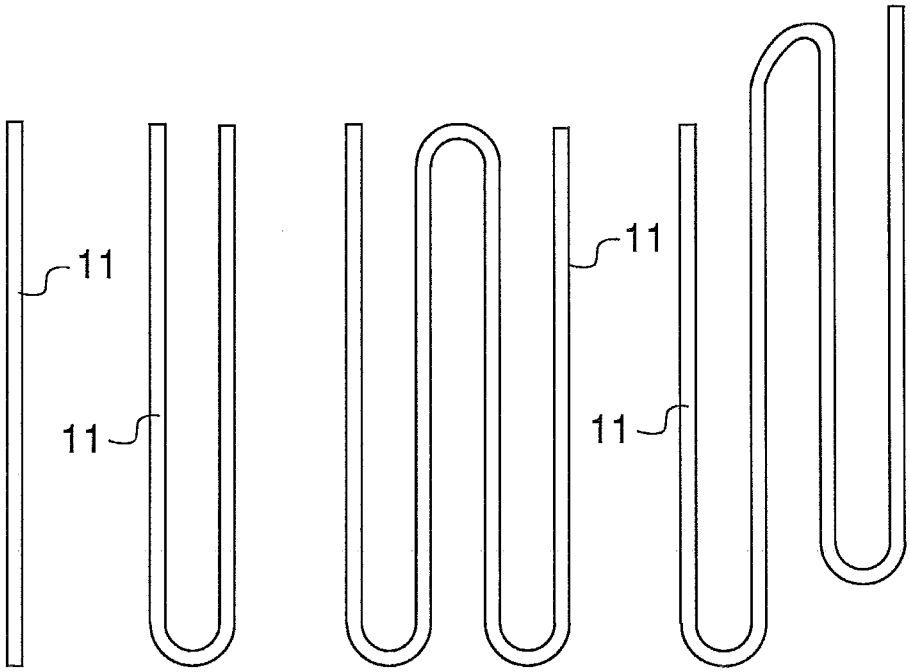
Figure 15:
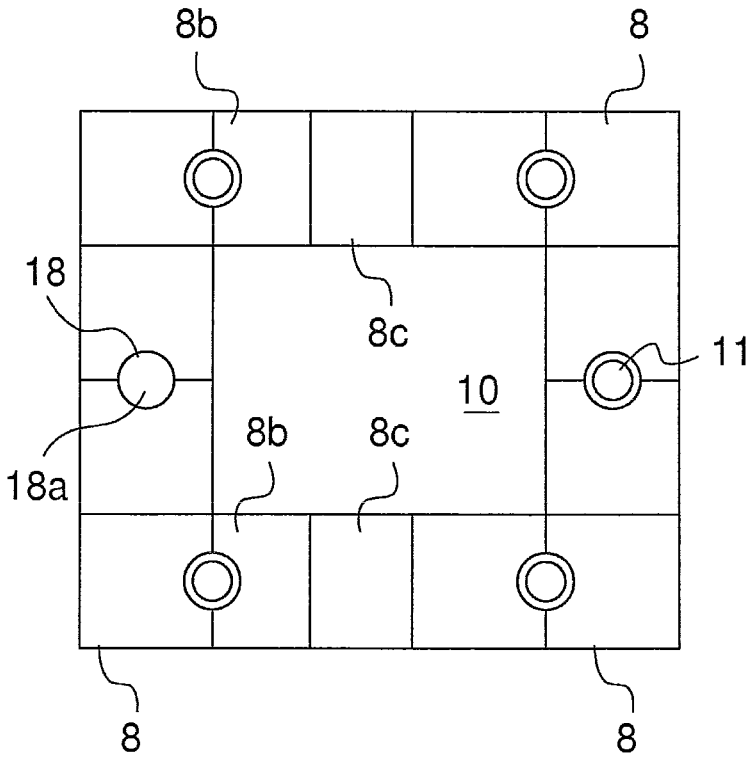

In the following, the invention will be described in more detail by the aid of some examples of its embodiments with reference to the attached drawings, wherein FIG. 1 presents an oblique and simplified top view of one 3-phase inductive component according to the invention, FIG. 2 presents a simplified and diagrammatic side view of one core according to the invention, which is assembled from structural elements, cross-sectioned through the center and comprises ducts ready for the cooling liquid pipes, FIG. 3 presents a simplified and diagrammatic end view of one core according to the invention, which is assembled from structural elements and comprises ducts ready for the cooling liquid pipes, FIG. 4 presents a simplified and diagrammatic side view of a part of a core according to the invention, which part is cross-sectioned through the center and provided with a cooling liquid pipe, FIG. 5 presents a simplified and diagrammatic side view of a part of a core according to the invention, which part is cross-sectioned through the center and provided with a cooling liquid pipe, in which solution also the winding is cooled with cooling liquid, FIG. 6 presents a simplified top view of a second structural element according to the invention for manufacturing a core, FIG. 7 presents a simplified end view of a second cooling pipe solution according to the invention, FIG. 8 presents a top view of the components of FIGS. 6 and 7 installed together, FIG. 9 presents a simplified and diagrammatic side view of a third solution according to the invention for implementing liquid cooling of the core, FIG. 10 presents an end view of a structural element of a core around a cooling liquid pipe, further simplified and applicable to the solution according to FIG. 9, FIG. 11 presents a simplified top view of one core of an inductive component according to the invention in the core assembly phase, FIG. 12 presents an oblique top view of one structural element of a core according to the invention, FIG. 13 presents an end view of various structural elements of a core according to the invention, FIG. 14 presents a simplified top view of various cooling pipe solutions according to the invention, and FIG. 15 presents a simplified end view of one solution according to the invention for implementing the liquid cooling of a core.

The idea of the invention is that liquid cooling ducts that function efficiently pass through an inductive core 2. In this way the loss produced in the core 2 can be efficiently transferred into the cooling liquid passing through the core 2. FIG. 1 presents an oblique and simplified top view of one 3-phase inductive component according to the invention, for the sake of clarity without the external cooling liquid tubing of the core 2. Shown here is a 3-phase dUdT filter, consisting of 1-phase chokes, each core 2 of which filter comprises small structural elements placed consecutively one after the other and preferably essentially similar to each other, which structural elements are pressed into one packet by means of end plates 3 and fixing screws 4. Air gaps can also be put in the interstices of the structural elements, with which air gaps the inductance value and damping can be adjusted. The inductive component could just as well be 1-phase. The solution according to the invention additionally comprises a base 1, on top of which the cores 2 with their windings 5 are disposed, and also connecting means 7 for connecting the filter to other devices. The ends of the cables of the windings 5 are fixed to headband connectors. Ordinary cable lugs could just as well be on the ends of the cables, and the lengths of the cables could be such that they extend to their final connection point. Additionally, the ends of the cores 2 comprise connectors 6 for connecting the input and the output of the cooling liquid tubes to the cores 2 before commissioning of the filter, and cooling liquid pipes are integrated inside the cores 2, which pipes are described in more detail later. It is possible to line this type of filter according to the invention completely with thermal insulation, in which case the heat transferring to the surrounding air can be almost completely eliminated.

It is characteristic to the structure according to the invention that the cooling liquid passes inside the core 2. In this case the structure comprises e.g. a core 2, which functions as the core of the inductive component, a pipe, along which the cooling liquid passes, and a thermal paste, which fits the structural elements of the core and the pipe thermotechnically together. The structure can be formed e.g. by pushing the pipe into a hole in the core 2 or by placing structural elements provided with grooves on top of the pipe/piping. In both methods there are different options for putting the thermal paste between the core and the pipe.

In practice, it is efficient to form the liquid ducting in the interfaces of the structural elements. In this case the core 2 can be built around the pipe/piping. The pipe and the core 2 are preferably electrically isolated from each other. This reduces the parasitic currents of the structure and lowers the propensity for corrosion. This can be done with the aforementioned suitable thermal paste. The pipe can also pass through one core or a number of cores. Correspondingly, a bent pipe can pass through one core or a number of cores a number of times.

The pipe does not necessarily need to pass through the core 2. It can turn to its outcoming direction already inside the core 2. Of course, this makes manufacturing more difficult, but it can be necessary in some cases. When the winding is made with an insulated cable, it is preferred to use a number of cables connected in parallel, in which case the structure is flexible and it has a lot of cooling area into the core 2.

FIGS. 2 and 3 present a simplified and diagrammatic view of one core 2 according to the invention, which is assembled from structural elements 8 that are essentially similar to each other. FIG. 2 shows the core 2 as viewed from the side and cross-sectioned through the center. Correspondingly, FIG. 3 shows the core 2 as viewed from the end.

It is practical to manufacture the core 2 of the inductive component from a number of smaller structural elements 8 that are essentially similar to each other. Metallurgical powder is particularly well suited to the manufacturing of this type of structural element 8. The structural element 8 is manufactured by compression from insulated metal powder. The completely assembled core 2 has ducts 9 ready for cooling liquid pipes. The apertures 9*a* that enable the ducts 9 of the cooling liquid pipes are manufactured into the core 2 already in the manufacturing phase of the structural elements 8 of the core 2, e.g. when pressing the structural elements 8, in which case a hole-type aperture 9*a* is left in the center of each structural element 8, or a groove on the side of it, in the pressing phase of the structural element 8. A cooling liquid pipe does not necessarily need to be disposed in all the ducts 9, but instead the quantity of pipes depends on each respective cooling requirement. In addition, the center of an assembled core 2 has a space 10 for the windings 5, which space 10 is formed from structural elements 8 when assembling the core 2.

FIG. 4 presents a simplified and diagrammatic side view of a part of a core 2 according to the invention, which part is cross-sectioned through the center and provided with a cooling liquid pipe 11, which pipe is disposed in a duct 9 formed by the structural elements 8. The cooling liquid pipe 11 is positioned in the duct 9 with a mechanical tolerance, in which thermal expansion can also be utilized, i.e. the pipe 11 is cooled before being placed into the duct 9. The tolerance-air gap between the pipe 11 and the duct 9 is filled e.g. with a thermally conductive paste, or with a corresponding paste, substance or solution intended for fitting the mechanical tolerances and for improving the thermal contact of the surfaces. This type of thermal paste also flexibly supports the setup. The cooling pipes 11 of one core 2 are connected into a continuous liquid circulation at the ends of the pipes 11, e.g. by means of the ducts 19 in the end plates 3. The pipes 11 can also be connected by means of hoses that are external to the core.

FIG. 5 presents a simplified and diagrammatic side view of a part of a core according to the invention, which part is cross-sectioned through the center and provided with a cooling liquid pipe, in which solution also the winding is cooled with cooling liquid. In this case the losses of the winding 5 can be transferred into the cooling liquid via the cores 2 such that the losses are conducted from the winding 5 to the core 2 through the insulation 12.

FIGS. 6-8 present a second cooling liquid solution according to the invention. In FIGS. 6 and 7 the parts to be fixed to each other are detached from each other, and in FIG. 8 they are fixed together. The cooling pipes 11 are replaced in this solution with an aluminium profile 14 essentially the length of the core 2 and the pipes 11, with which aluminium profile a larger cooling surface is obtained than with just the pipes 11. This type of element 14 can also cool the winding 5 such that losses are conducted from it to the profile 14. The aluminium profile 14 comprises a frame part 17 that transfers heat well and a pipe-like part 16 that is essentially round in its cross-sectional shape, inside which part 16 is a hole the length of the whole profile 14 for the cooling liquid.

The structural elements 8*a* used in this solution comprise an essentially round aperture 13 at both ends that functions as a part of the duct, the rim of which is open on the outer surface of the end of the structural element 8*a*. The pipe-like part 16 of the aluminium profile 14 and the aperture 13 are dimensioned with respect to each other such that the pipe-like part 16 locks into the apertures 13 of the structural elements 8*a* placed one after the other or one on top of the other, and the wider frame part remains against the outside edges of the structural elements 8*a*. The length of the aluminium profile 14 is essentially the same or greater than the combined length of the structural elements 8*a* placed one after the other or one on top of the other, i.e. the length of the core 2.

FIGS. 9-11 present a third preferred solution according to the invention. The structure can be made to be more manufacturing-friendly by making the joints of the pipes 11 at both ends of the core 2 by means of separate liquid connection flanges that function as end plates 3. In this case the assembly is performed e.g. such that first the ready circulation structure of the cooling liquid is constructed by means of the end plates 3 and the pipes 11, in which circulation structure the pipes are fixed to the end plates e.g. by using a welded joint, crimped joint, swaged joint, glued joint or other suitable joint. Other jointing methods of the pipes are, among others, connection by means of threads, soldering, the utilization of thermal expansion and laser welding, as well as metallic and plastic cast pieces and also pipe connectors such as a pipe beading. Finally the structural elements 8 of the core 2 are placed in the circulation structure of the cooling liquid for assembling the core 2 to completion by placing two essentially similar structural elements 8 against each other at their sides that comprise a groove 18 of a semicircular cross-sectional shape such that the structural elements 8 of the core 2 that are provided with a semicircular groove 18 at one of their sides are situated under and on top of or on both sides of the cooling pipe 11 so that at the end the pipe 11 remains at the end almost completely inside the structural elements 8. A thermally conductive paste is preferably placed into the grooves 18 before disposing the structural elements 8 around the pipes 11. In the assembly phase the structural elements 8 are glued together at their surfaces and ends that face each other.

FIG. 11 presents a simplified structure, in which first a ready liquid circulation structure is constructed by means of the end flanges 3 and the pipes 11, on top of which structure finally the structural elements 8 of the core are placed in the assembly phase of the core, which structural elements at the same time come around the pipes 11 and are glued to each other. The pipes 11 of one core are connected to each other into a continuous liquid circulation by means of the ducts that are in the end flanges 3, which ducts are not shown in the figure. The pipes 11 can also be connected by means of hoses that are external to the core. By manufacturing the piping in this way first, the joints of the liquid circulation can be manufactured more freely, e.g. by laser welding or by casting. Likewise the liquid circulation can already be tested in an early phase. In FIG. 11 only some of the structural elements 8 of the core have been placed into position. There are e.g. 1-10, suitably 2-8 and preferably e.g. 4-6 units of pipes in the circulation structure of the cooling liquid.

The end plates 3 comprise a liquid-proof cover and the connections to the pipes 11 are also liquid-proof. In addition, there is liquid ducting 19 inside the end plates 3, which liquid ducting connects all the pipes 11 in parallel with each other, in which case the liquid pipes 11 function on a so-called "parallel connection" principle. Thus the 1-phase choke formed by one core 2 forms one liquid circulation entity. Both ends of the core 2 comprise e.g. one connector 6, in which case the cooling liquid is brought to the core with a tube via a first connector 6 and conducted back into circulation and out from the core 2 via a second connector 6. The liquid ducting 19 is connected to a connector 6 at both ends of the core 2, so that the cooling liquid circulates via all the pipes 11. When, for example, three chokes are connected together as one 3-phase component, the circulation of the cooling liquid is fitted at both ends via a separate header manifold, which distributes the cooling liquid to each choke on the parallel connection principle. In this case also it is sufficient to have one tube, which brings the cooling liquid to the header manifold at the first end of the core, and another tube that takes the cooling liquid onwards from the header manifold at the second end of the core.

The groove 18 that essentially corresponds to the diameter of the pipe 11 and that is on one flat surface of each structural element 8 encloses the ready piping inside in the finished assembly when the structural elements 8 have been placed face to face. Thus the core 2 can be assembled around the ready cooling piping.

FIGS. 12 and 13 present a simplified view of the structural elements 8 of a core, manufactured e.g. by pressing, that are used in the solution according to the invention. FIG. 12 presents an oblique top view of one structural element 8 and FIG. 13 presents some different models of structural elements 8 as viewed directly from the end. The dimensions of a structural element and also the number, size, shape and positioning of the grooves 13, 18 and holes 9 forming ducts can differ depending on the structural element. A structural element 8 can be a solid rectangular polyhedron shape, in which each face is flat, or a structural element 8 can be otherwise the rectangular polyhedron stated above but the structural element comprises a hole 9 in the middle that is the length of the structural element for the cooling pipe. The structural element 8 can also be a different shape than a rectangular polyhedron. Instead of a hole 9, the structural element 8 can also comprise a groove 13, 18, which is of a semicircular or rectangular cross-sectional shape or some other cross-sectional shape and is the length of the structural element, on one or more surfaces. There are thus no grooves 13, 18 or holes 9 at all or one, two or more of them, and they are made in the structural element 8, 8*a* in the pressing phase of the structural element.

By means of the groove 18, a duct is formed, if necessary, for a liquid cooling pipe by placing two structural elements 8 against each other such that the grooves 18 are also placed against each other. It is easier to install the liquid cooling pipe 11 into this type of structure than into a hole 9. The duct formed by the grooves 18 is preferably larger than the outside diameter of the liquid cooling pipe 11 to the extent of a suitable tolerance. The space remaining between the pipe 11 and the wall of the groove 18 is preferably filled with a thermally conductive paste. The task of the thermal paste is to ensure the transfer of heat from the core 2 into the liquid cooling pipe 11, and also to even out the effect of mechanical tolerances and thermal expansion. This type of thermal paste also forms an electrically insulating layer between the core 2 and the pipe 11, which layer reduces the occurrences of undesired currents into the structure.

FIG. 14 presents a simplified view of various cooling pipe solutions according to the invention. The liquid cooling pipe 11 can be straight, or it can also be bent into an elongated U-shape, in which case fewer connectors are needed than when two straight pipes are used and connected together. The pipe 11 can also have a number of bends at both ends. This type of structure is presented as the third pipe structure from the left in FIG. 14. The structure on the right-hand side in FIG. 14 presents a liquid cooling pipe 11, which comprises bends in a number of dimensions and directions. Thus the parts of a pipe can be on different levels. When using structural elements 8 that comprise open grooves 18, the structural elements 8 can be installed in a number of dimensions on top of a bent pipe 11. The structural elements 8 that contain holes 9, on the other hand, cannot be slid in many directions on top of a bent pipe 11 because they would easily get caught on the bends of the pipe. The use of a bent pipe and/or pipes is cost-effective compared to the use of a number of straight pipes that are combined with end flanges.

From the viewpoint of assembly, it is preferable to use the core structure presented in FIG. 15, which structure comprises structural elements 8, 8*b* and 8*c* of the core that are of different sizes to each other. The structural elements 8 and 8*b* are provided on one side with a groove 18 of e.g. semicircular cross-sectional shape, which grooves 18 when placed against each other form a duct 18*a* e.g. for a cooling liquid pipe 11. Although each structural element 8, 8*b* comprises a groove 18 or a hole 9 made in the manufacturing phase of the structural element 8, 8*b* that extends through the structural element 8, 8*b*, which groove or hole is itself a part of the duct 18*a* intended for the purpose of liquid cooling, a liquid cooling pipe 11 does not, however, necessarily need to be placed into all the ducts 18*a* thus formed, but instead the quantity of pipes 11 depends on each respective cooling requirement. In addition, the center of an assembled core 2 has a space 10 for the windings 5, which space 10 is formed from the structural elements 8, 8*b*, 8*c* when assembling the core 2.

Correspondingly, the structural element 8*c* is flat on all its surfaces. In addition, the structural element 8 is the largest in its cross-section, and the structural elements 8*b* and 8*c* are correspondingly smaller in their cross-section than the structural element 8. The larger structural elements 8 are used e.g. in the corners of the core structure and in places into which the structural elements 8 are easy to install. On the other hand, the smaller structural elements 8*b* and 8*c* are used in the final phase of the assembly of the core, in which phase there is less space around the pipes 11 and the structural elements must be installed perhaps from unfavorable directions.

The idea of assembling the core is that the cross-sectionally small and flat structural element 8*c* is placed into its position by suitably fitting it last of all. In this case the structural elements 8 and 8*b* provided with a groove 18 can be installed more freely into their positions from the best possible direction. This is important so that the thermal paste placed into the grooves 18 of the structural elements 8 and 8*b* stays as well as possible in place when installing a structural element 8 and 8*b* into its position. If the structural elements 8 of the core that are provided with a groove 18 were fitted in the final phase of the assembly into their positions in the direction of the pipes 11, the thermal paste would easily be wiped out of the grooves 18. Also, the thermal paste and the glue in the structural elements 8, 8*b*, 8*c* of the core would foul the pipe 11 and particularly the end of the pipe 11, the making of a joint to which end would then be more difficult. In the assembly of the core seen in FIG. 15, the last structural element 8*c* to be placed into its position can, instead of being flat, also be provided with some suitable groove, e.g. with the groove 18, although nothing would be disposed in the groove. Thus the structural elements 8*b* or 8*c* without a groove or with a groove but without a pipe can freely be placed as the last.

The winding can be made e.g. with busbars or with cables 5. Especially when using cables, they can be efficiently pressed using suitable insulation tightly into the cores 2, in which case they cool via the cores 2 into the cooling liquid. When using cables 5, also more than one winding turn can easily be produced and by placing a suitable quantity of cables in parallel a sufficient conductor surface area for each current value is obtained. In addition, the insulation of the cables 5 takes care of the insulation of electrical parts, in which case disruptive discharge problems caused by accretion typical to busbar solutions are not able to occur. From the viewpoint of the cooling of the winding, fixing the cables 5 or the busbars directly to the iron parts of the core is a significant improvement compared to conventional solutions.

The cooling pipes passing through the structure of the core 2 can be separate pipes 11, 16 or they can be manufactured directly into the structural elements 8 of the core 2. The pipes manufactured into the structural elements 8 can be manufactured as a so-called "high-porosity" structure, i.e. as a porous structure through which liquid permeates. The porous material can be on only the edges of the pipes or on the whole area of a pipe. This type of high-porosity structure efficiently transfers heat from the core 2 into the cooling liquid, because the flow inside it is rotational i.e. turbulent. Likewise the inside area of the pipe made from porous material is large. When using separate pipes 11 they can be provided with separate turbulators, such as e.g. with spirals, which make a laminar flow turbulent even at a low flow speed, in which case the transfer of heat from the pipe 11 into the cooling liquid becomes more efficient. This type of effect is also achieved with separate shapes, such as with bumps or flutes, made on the inner surface of the pipes 11. It is best to coat a high-porosity structure with a coating that prevents corrosion, such as with an aluminium or nickel coating. Separate pipes 11, the aforementioned high-porosity structure or other duct structures form, either together or separately, the liquid duct structure of the core 2 according to the invention.

Any magnetic material whatsoever can be used as the core material of the filter. It is, however, preferable to use core material that is based on metal powder instead of a laminate-based one because it keeps its inductance up to a higher frequency than silicon steel laminate.

It is also preferred that the winding 5 comprises two or more turns, in which case the damping of the filter does not decrease at high frequencies. This type of structure is used particularly in dUdT filters. When using only one turn, a significant part of the magnetic field passes in the air space between the winding 5 and the core 2, and the damping effect of the core 2 is not directed into this part, in which case the damping of the whole filter decreases.

The filter according to the invention is also efficient because it can be made to be angular and compact. For example a toroid core wound from a silicon steel band does not fit into as small a space as a core 2 assembled from rectangular structural elements 8, 8*a*, 8.

With the method according to the invention, an inductive component is manufactured e.g. as follows.

The core 2 of the inductive component is manufactured from a number of smaller structural elements 8, 8*a*, 8*b* that are essentially similar to each other, and which are assembled into a packet of the size and shape of the core 2 designed for the application. Any magnetic material whatsoever can be used as the material of the structural elements 8, 8*a*, 8. Core material based on metal powder is used as the material according to the invention. The structural element 8*a*, 8, 8 is manufactured e.g. from metal powder by pressing such that the structural element 8, 8*a*, 8 is pressed into an essentially rectangular-shaped piece, in which all the sides are essentially right-angled. In connection with the pressing phase an aperture 9*a*, 13, 18 that goes in one direction through the structural element is also formed in the structural element 8, 8*a*, 8, for the use of the cooling liquid. The aperture 18 in the structural element 8 is essentially semicircular, which becomes a full circle when two similar structural elements 8 are placed against each other in the assembly phase of the core 2.

In the assembly phase of the core 2 of an inductive component the structural elements 8, 8*a*, 8 are placed together consecutively one after the other and, if necessary, side-by-side and one on top of the other such that the apertures 9*a*, 13, 18 of the structural elements 8, 8*a*, 8 in at least one direction form an essentially straight duct 9 extending essentially through the whole core 2.

After the assembly of the structural elements 8, 8*a* of the core 2, a cooling liquid pipe 11 or a corresponding pipe-like means 16 is placed into the duct 9. Thermal expansion is utilized in the installation such that the pipe 11 or corresponding pipe-like means 16 is cooled before being placed into the duct 9. The tolerance-air gap between the pipe 11, 16 and the duct 9 is filled, if necessary, with a thermally conductive paste, such as with a 2-component paste. After this the pipes 11, 16 that have been installed into the cores 2 are connected to each other into a continuous liquid circulation by means of the end plates provided with liquid ducting 19, connectors 6 and tubes.

Another method to manufacture a liquid-cooled inductive component is to assemble the liquid circulation with pipes 11, 16 and possible end plates 3 first, after which the structural elements 8 provided with semicircular apertures 18 are assembled around the finished piping into a packet of the size and shape of the core 2 designed for the application.

To improve the efficiency of the cooling, the pipes 11, 16 are provided, if necessary, with separate turbulators, such as e.g. with spirals or with corresponding means that produce a turbulent flow, such as with bumps or flutes, all of which are disposed inside the pipes 11, 16.

An aluminium profile 14, on top of the pipe part 16 inside which aluminium profile the structural elements 8*a* that form the core 2 are assembled consecutively to each other, is used as a liquid cooling element, if necessary, in addition to or instead of the pipe 11.

Yet another way to implement the liquid cooling is to manufacture the cooling piping as parts directly inside the structural elements 8 in the pressing phase of the structural elements. This type of cooling piping is constructed as e.g. a so-called "high-porosity" structure, i.e. as a porous structure through which liquid permeates. The porous material is disposed in the pressing phase either only on the edges of the pipes or on the whole area of a pipe. When the structural elements 8 manufactured in this way are assembled together into one packet in the manufacturing phase of the core 2, the holes of the structural elements 8 set consecutively settle into a straight row one after another and thus form a ready pipe or a duct 9. The surfaces of the structural elements 8 that touch each other are sealed to each other, e.g. by gluing, so that the cooling liquid is not able to leak from the gaps between the structural elements 8.

It is obvious to the person skilled in the art that different embodiments of the invention are not limited to the examples described above, but that they may be varied within the scope of the claims presented below. Thus, for example, the same manufacturing methods, materials and structures can also be applied in the manufacturing of other chokes and filters, such as LC, LCL and harmonic chokes.

It is also obvious to the person skilled in the art that the cooling solution according to the invention can also be applied to a conventional three-pillar choke instead of the 3×1-phase solution presented above.

It is also obvious that the core of an inductive component presented above can be made as a laminated structure, in which case the holes for the pipes are made in the manufacturing phase of the laminates and the cooling liquid pipes are placed inside the core structure assembled from the laminates in the same manner as presented above.

Likewise, it is further obvious to the person skilled in the art that the winding can also be a flat copper or aluminium rod, which is installed when insulated into the core structure and thus cools into the core that is cooled with the liquid.

The invention claimed is:

1. An inductive component equipped with liquid cooling, comprising:

a core assembled from separate structural elements;

a winding;

a connection unit for connecting the inductive component to another device; and ducts integrated into the core for the purpose of liquid cooling, wherein the structural elements are assembled side-by-side and one on top of the other around an existing structure of interconnected liquid cooling pipes, in order to build the core to cover at least part of the structure, the structural elements being assembled in such manner as to provide a space within the core which houses the winding, the structural elements are rectangular polyhedron in shape and are manufactured by pressing from metal powder, and at least some of the structural elements have an aperture or groove, said apertures or grooves being fitted to form liquid cooling ducts either alone or when placed face to face, and at least some of the liquid cooling ducts are formed around respective ones of the interconnected liquid cooling pipes, said liquid cooling pipes are disposed to cool the core.

2. The inductive component according to claim 1, wherein the aperture in the at least some of the structural elements is an essentially round hole in the structural element.

3. The inductive component according to claim 1, wherein said apertures or grooves include a groove on one flat surface of one of the structural elements, said groove essentially corresponding to the diameter of the liquid cooling pipe, said groove being fitted to form a suitable aperture for the liquid cooling pipe in the finished assembly with the structural elements being placed face to face.

4. The inductive component according to claim 1, wherein the liquid cooling pipe has bendings and goes several times through the core.

5. The inductive component according to claim 1, wherein each of the at least some of the structural elements has a groove that has been manufactured when the structural element has been pressed from powder.

6. The inductive component according to claim 1, wherein a quantity of liquid cooling pipes inside the core is according to a cooling requirement.

7. The inductive component according to claim 1, wherein the winding is cooled to liquid inside the liquid cooling pipes through the core by compressing the winding tightly to core.

8. The inductive component according to claim 1, wherein the winding is made of insulated cable.

9. The inductive component according to claim 5, wherein a quantity of cooling pipes inside the core is according to a cooling requirement.

10. The inductive component according to claim 6, wherein the winding is cooled to liquid inside the liquid cooling pipes through the core by compressing the winding tightly to core.

11. The inductive component according to claim 7, wherein the winding is made of insulated cable.

12. A method for manufacturing an inductive component equipped with a liquid cooling structure, wherein the inductive component comprises at least a core assembled from separate structural elements, a winding, a connection unit for connecting the inductive component with another device as well as ducts integrated into the core for the purpose of liquid cooling, comprising:

assembling the structural elements side-by-side and one on top of the other around an existing structure of interconnected liquid cooling pipes, in order to manufacture the core to cover at least part of the structure, the structural elements being assembled in such manner as to provide a space within the core which houses the winding; and manufacturing the structural elements rectangular polyhedron in shape by pressing metal powder, such that:

at least some of the structural elements have an aperture or groove, said apertures or grooves being fitted to form liquid cooling ducts either alone or when placed face to face, and at least some of the liquid cooling ducts are formed around respective ones of the interconnected liquid cooling pipes such that said liquid cooling pipes are disposed to cool the core.

13. The method according to claim 12, wherein the aperture in the at least some of the structural elements is an essentially round hole in the structural element.

14. The method according to claim 12, wherein said apertures or grooves include a groove on one flat surface of one of the structural element comprises, said groove essentially corresponding to the diameter of the cooling liquid pipe, said groove being fitted to form a suitable aperture for the liquid cooling pipe in the finished assembly with the structural elements being placed face to face.

15. The method according to claim 12, wherein a bended liquid cooling pipe that goes several times through the core is used.

16. The method according to claim 12, wherein the manufacturing of the structural elements includes manufacturing a groove for each of the at least some of the structural elements when the structural element is pressed from powder.

17. The method according to claim 12, further comprising determining a quantity of liquid cooling pipes to be placed inside the core according to a cooling requirement.

18. The method according to claim 12, wherein the winding is compressed tightly to the core in order to cool the winding to liquid inside the liquid cooling pipe through the core.

19. The method according to claim 12, wherein the winding is manufactured using insulated cable.

20. The method according to claim 14, wherein the winding is compressed tightly to the core in order to cool the winding to liquid inside the liquid cooling pipe through the core.

* * * * *